US005419692A

United States Patent [19]

Irino

[11] Patent Number: 5,419,692

[45] Date of Patent: May 30, 1995

[54] CLOSED TYPE COMPRESSOR

[75] Inventor: Yasumi Irino, Fuji, Japan

[73] Assignee: Kabushiki Kaisha Toshiba, Kawasaki, Japan

[21] Appl. No.: 930,385

[22] PCT Filed: Jan. 9, 1992

[86] PCT No.: PCT/JP92/00007

§ 371 Date: Sep. 4, 1992

§ 102(e) Date: Sep. 4, 1992

[87] PCT Pub. No.: WO92/12348

PCT Pub. Date: Jul. 23, 1992

[30] Foreign Application Priority Data

Jan. 9, 1991 [JP] Japan ..... 3-000911

[51] Int. Cl.[6] ..... F01C 21/04

[52] U.S. Cl. ..... 418/83; 417/902

[58] Field of Search ..... 418/83, 63; 417/902

[56] References Cited

U.S. PATENT DOCUMENTS 4,645,429 2/1987 Asami et al. ..... 417/312

FOREIGN PATENT DOCUMENTS 53-120305 9/1978 Japan .
0562494 1/1981 Japan .
0140496 8/1983 Japan ..... 418/83
60-237184 11/1985 Japan .
0618492 1/1986 Japan .
62-18385 2/1987 Japan .
0265490 11/1987 Japan .

*Primary Examiner*—Richard A. Bertsch
*Assistant Examiner*—Charles G. Freay
*Attorney, Agent, or Firm*—Foley & Lardner

[57] ABSTRACT

The present invention is to prevent heat exchange between sucked gas in a portion of a suction duct and hot gas within a casing, the portion of the suction duct extending in a closed casing. A gas compressed in a cylinder is introduced into an outer intermediate radiator, and the cooled compressed gas is refluxed to a closed casing through a return duct. A duplex connection duct which has an inner duct and an outer duct coaxially combined is connected to a connection end portion of the suction duct on the compressor side, the inner duct communicating to the suction duct whereas the outer duct communicates to the return duct. The return duct is connected to the outer duct on the outside of the closed casing, and this outer duct is formed open at one end in the inside of the closed casing.

8 Claims, 2 Drawing Sheets

CLOSED TYPE COMPRESSOR

FIELD OF THE ART

The present invention relates to a closed type compressor, and particularly relates to a closed type compressor in which a coolant gas which has been compressed in the compressor is introduced into an intermediate radiator, where the coolant gas is cooled and then refluxed to the closed casing of the compressor.

BACKGROUND OF THE ART

FIG. 2 illustrates an essential part of the structure of a compressor unit of a conventional closed type rotary compressor, and the reference numeral 1 indicates a casing. A rotary shaft 2 is accommodated in the casing 1, and this rotary shaft 2 is rotatably supported on a main bearing 3 and a sub-bearing 4. A cylinder 5 is held between the main bearing 3 and the sub-bearing 4, and a crank portion 6 is formed in the rotary shaft 2 between the main bearing 3 and sub-bearing 4. A ring-shaped roller 7 is fitted around the outer circumference of this crank portion 6. As the rotary shaft 2 rotates, the roller 7 is eccentrically rotated in the cylinder 5, and thereby the volume of the compressor chamber which is formed in the cylinder 5 is varied, so that the suction and compression of the coolant gas is carried out. In these events, coolant gas is sucked in the compressor chamber through a suction duct 8 whereas compressed gas issues out from a discharge duct not shown through the casing 1. The cylinder 5 is provided with a flat blade 9 for slidable movement in the radial direction of the rotary shaft 2. This blade 9 is spring biased by a compression spring 10 toward the axis of the rotary shaft 2. Accordingly, the edge of the blade 9 is always brought into contact with the outer circumferential surface of the roller 7. The eccentric rotation of the roller 7 causes the blade 9 to be reciprocally moved, so that oil accumulated in the bottom portion of the casing 1 is supplied to a predetermined portion to be lubricated through an oil pipe 11.

In such a closed type compressor, the temperature of the compressor is elevated due to compressed hot and high pressure coolant gas and heat generation of the motor during long running times. The hot and high pressure coolant gas and inner components of the casing 1 make direct contact, and therefore the structural parts are overheated during continuous running of the compressor, so that the compressor is deteriorated in reliability and volumetric efficiency.

To solve such a problem, there has been proposed an intermediate radiator system, in which compressed gas is introduced into an outer intermediate radiator for cooling, and then refluxed to the casing of the compressor to prevent overheating. Prior art of this type of compressor are disclosed and known in Japanese utility model examined publication No. 60(1985)-237184, Japanese utility model unexamined publication 62(1987)-18385, and Japanese patent unexamined publication 60(1985)-237184, for example.

Even in the case where compressed gas is once cooled through the intermediate radiator, a part, located within the casing, of the suction pipe which sucks coolant gas into the cylinder directly contacts hot and high temperature gas. This part is the part of the suction pipe which extends to and is connected with the cylinder. Thus, the temperature of coolant gas sucked into the cylinder is raised. This produces a problem in that the compressor is deteriorated in volumetric efficiency in spite of the cooling effect of the intermediate radiator.

Accordingly, an object of the present invention is to provide a closed type compressor which is capable of effectively preventing overheating of the compressor with an intermediate radiator by preventing direct contact between the portion, arranged within the casing, of the suction pipe and the hot, high temperature gas, whereby the problem of the prior art is overcome.

DISCLOSURE OF THE INVENTION

In a closed type compressor in which a gas which has been compressed in a cylinder chamber is introduced into an outer intermediate radiator, and the cooled compressed gas is returned to a closed casing through a return duct, the present invention is characterized to achieve the object above described in that: a duplex connection duct having an inner duct and an outer duct coaxially combined is connected to a compressor side connection end portion of a suction duct, the inner duct communicating to the suction duct whereas the outer duct communicates to the return duct; the return duct is connected to the outer duct on the outside of the closed casing; and the outer duct is formed to be open at one end in the inside of the closed casing.

According to the present invention, a duplex connection duct having an inner duct and an outer duct coaxially combined is connected to a compressor side connection end portion of a suction duct, the inner duct communicating; to the suction duct whereas the outer duct communicates to the return duct; the return duct is connected to the outer duct on the outside of the closed casing; and the outer duct is formed to be open at one end in the inside of the closed casing. Therefore, coolant gas which refluxes from the return duct flows in the outer duct, and heat exchange in a portion extended in the casing between sucked gas and inner gas is prevented, the sucked gas flowing through the inner duct while the inner gas being in the casing. This suppresses elevation of the temperature of sucked gas. Overheating of the compressor with the intermediate radiator is therefore effectively prevented, and volumetric efficiency is enhanced. Thus, the capacity of compressor is improved.

BEST MODE TO PRACTICE THE INVENTION

Figure 1:
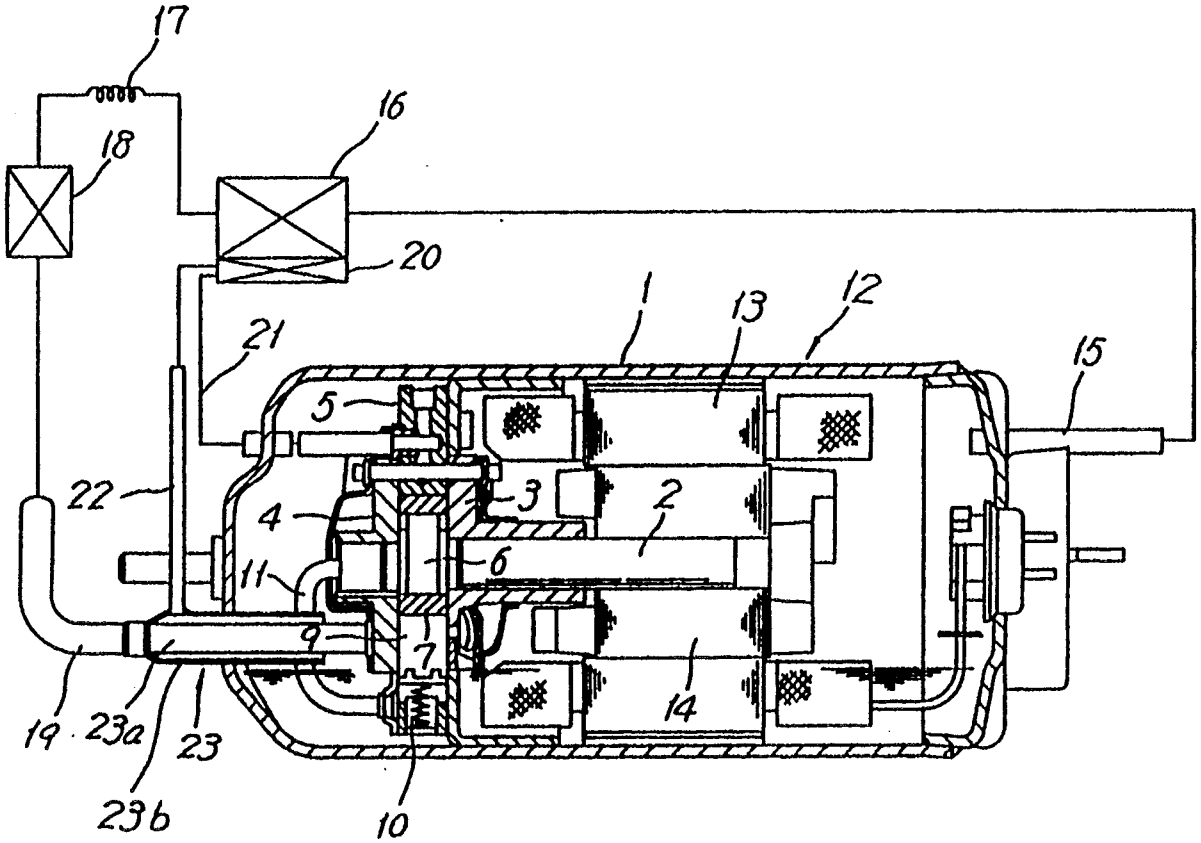
FIG. 1 is a vertical sectional view illustrating one embodiment of a closed type rotary compressor according to the present invention which is incorporated into a refrigerating cycle.
Figure 2:
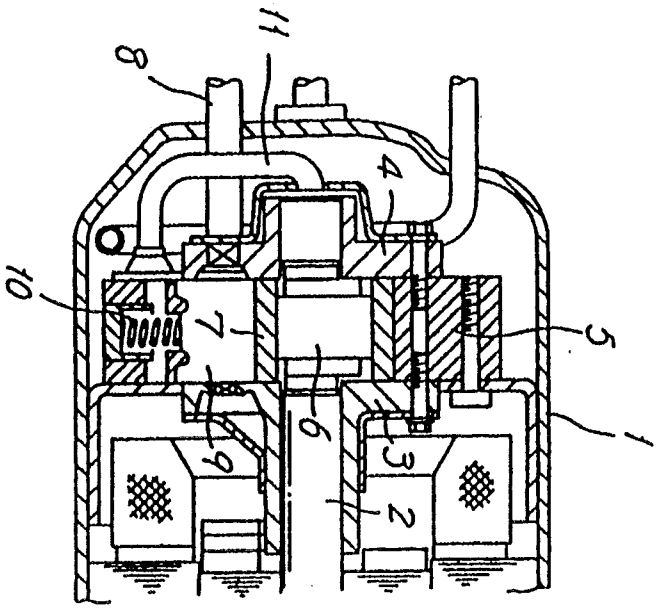
FIG. 2 PRIOR ART
FIG. 2 is a vertical sectional view which shows an essential portion of the rotary compressor according to the prior art.

Referring to FIG. 1, one embodiment of the present invention in which a closed type compressor according to the present invention is applied to a rotary compressor will be described hereinafter.

The rotary compressor generally indicated by the reference numeral 12 is provided with a casing 1, in which a rotary shaft 2 is received. This rotary shaft 2 is rotatably supported by a main bearing 3 and a sub-bearing 4. A cylinder 5 which constitutes a compressor unit is held between the main bearing 3 and the sub-bearing 4, and a crank portion 6 is formed in the rotary shaft 2 between the main bearing 3 and sub-bearing 4. A ring-shaped roller 7 is fitted around the outer circumference of this crank portion 6. As the rotary shaft 2 rotates, the roller 7 is eccentrically rotated in the cylinder 5, and thereby the volume of the compressor chamber which is formed in the cylinder 5 is varied, so that the suction and compression of the coolant gas is carried out.

The cylinder 5 is provided with a flat blade 9 for slidable movement in the radial direction of the rotary shaft 2. This blade 9 is spring biased by a compression spring 10 toward the axis of the rotary shaft 2, and the edge of the blade 9 is always brought into contact with the outer circumferential surface of the roller 7. The eccentric rotation of the roller 7 causes the blade 9 to be reciprocally moved, so that oil accumulated in the bottom portion of the casing 1 is supplied to a predetermined portion to be lubricated through an oil pipe 11.

On the other hand, in the casing 1, there is fastened a hollow cylindrical stator 13 which constitutes an electric motor unit, and a rotor 14 is mounted to the rotary shaft 2. The discharge duct 15 of the rotary compressor 12 is connected to the inlet side of the condenser 16, of which outlet side is communicated to an evaporator 18 through a capillary tube 17. The outlet side of the evaporator 18 is connected to a suction port of the rotary compressor 12 through a suction tube 19 and a duplex connection pipe 23 which will be described below. Thus, a refrigeration cycle is constructed.

On the other hand, the reference numeral 20 designates an intermediate radiator provided to the condenser 16. This intermediate radiator 20 and the discharge port of the cylinder 5 of the rotary compressor 12 are interconnected through a discharge duct 21. Hot, high pressure coolant gas which has been compressed in the compression chamber within the cylinder 5 is firstly introduced into the intermediate radiator 20 through the discharge duct 21 and is cooled there. The terminal end of a return duct 22 which extends out from the outlet side of the intermediate radiator 20 is connected to the duplex connection pipe 23 which is connected to the connection end of the suction tube 19 on the side of the rotary compressor 12. This duplex connection pipe 23 is constituted by coaxially combining an inner duct **23*a* and an outer duct 23*b*. In this embodiment, the inner duct 23*a* communicates at one end thereof to the suction tube 19 and the other end extends into the casing 1 to be connected to a suction port of the sub-bearing 4, thus communicating to the compression chamber of the cylinder 5. As described, in this embodiment the suction tube 19 and the inner duct 23*a* are separately formed but the suction tube 19** may extend to replace the inner duct.

The outer end, located outside the casing 1, of the outer duct **23*b* is sealed whereas the inner end thereof which is positioned within the casing 1 is formed as an open end, which extends closely to the sub-bearing 4**.

Hot and high pressure coolant gas which has been compressed by sucking into the cylinder 5 from the suction tube 19 through the inner duct **23*a* of the duplex connection pipe 23 is once introduced into the intermediate radiator 20 through the discharge duct 21. Coolant gas which has been cooled and dropped in temperature in this intermediate radiator 20 is discharged to the interior of the casing 1 from the open end of the outer duct 23*b* of the duplex connection pipe 23 through the return duct 22, passes through between components within the casing 1, and issues out to the refrigeration cycle from the discharge duct 15. By refluxing compressed gas from the intermediate radiator 20 in such a manner overheating of the compressor is primarily prevented. It is to be noted that in this case low temperature compressed gas which is discharged from the open end of the outer duct 23*b* is spread toward the cylinder 5, and thus an effect of cooling the cylinder 5 is obtained. Cooled gas from the intermediate radiator 20 is introduced into the casing 1 through the outer duct 23*b* which covers over the inner duct 23*a*, so that sucked gas which passes through the inner duct 23*a* is prevented from being elevated in temperature due to heat exchange with relatively hot compressed gas in the casing 1**.

Supposing that compressed gas which is refluxed from the intermediate radiator 20 is not subjected to any heat exchange while it passes through the outer duct **23*b*, the heat exchanger duty $Q_1$ exchanged between sucked gas and compressed gas in the casing 1** is given by $$Q_1 = K_1 \cdot A(K_{G1} - T_S) \quad (1)$$

where: $T_S$ is the temperature of sucked gas in the inlet side of the cylinder 5, the sucked gas having been introduced from the suction tube 19 through the inner duct **23*a*; $T_{G1}$ the temperature of gas in the casing 1; the constant $K_1$ the total heat transfer coefficient through the inner duct 23*a*; and the constant A a heat transfer area of the inner duct 23*a***.

In a practical case where the temperature $T_S$ of sucked gas in the inlet side of the casing 1 is about 32° C., the temperature $T_{G\,1}$ of gas in the casing 1 is elevated to about 110° C. Accordingly, $Q_1$ is given from the equation (1).

$$\begin{aligned} Q_1 &= K_1 \cdot A(110 - 32) \\ &= 78K_1 \cdot A \end{aligned}$$

In this embodiment, the temperature of compressed gas which is cooled in the intermediate radiator 20 and refluxes through the outer duct **23*b*** is represented as $T_{R2}$, and the total heat transfer coefficient as $K_2$ since in this case the condition of heat exchange is different. The heat exchanger duty $Q_2$ which is heat exchanged between the compressed gas and sucked gas is given by $$Q_2 = K_2 \cdot A(K_{R2} - T_S) \quad (2)$$

Here, compressed gas which flows back from the intermediate radiator 20 is usually cooled to about 60° C., and therefore from the equation (2) $Q_2$ is given by $$\begin{aligned} Q_2 &= K_2 \cdot A(60 - 32) \\ &= 28K_2 \cdot A \end{aligned}$$

In this case, $K_1 \geqq K_2$ on usual conditions, thus $$Q_1 >> Q_2$$

Accordingly, the amount of heat exchange between sucked gas flowing through the inner duct **23*a* and compressed gas flowing back through the outer duct 23*b*** is small, and it is possible to keep heat elevation of the sucked gas small, so that sucked gas may be small in specific volume. This and the effect of preventing overheating by the intermediate radiator system enhance the compressor in volumetric efficiency.

INDUSTRIAL UTILITY

Closed type rotary compressors according to the present invention may be widely used in domestic, office, and vehicle air conditioning equipment.

I claim:

1. A closed type compressor in which a gas which has been compressed in a cylinder chamber is introduced into an outer intermediate radiator, and the cooled compressed gas is returned to a closed casing through a return duct, characterized in that: a duplex connection duct having an inner duct and an outer duct coaxially combined is connected to a compressor side connection end portion of a suction ducts the inner duct communicating to the suction duct whereas the outer duct communicates to the return duct; the return duct is connected to the outer duct on the outside of the closed casing; and the outer duct is formed to be open at one end in the inside of the closed casing.

2. A closed type compressor as recited in claim 1, characterized in that the inner duct of the duplex connection duct is constructed by a common part of the suction duct.

3. A closed type compressor as recited in claim 1, characterized in that the end of the outer duct of the duplex connection duct terminates in the vicinity of a sub-bearing of the compressor unit.

4. An apparatus comprising:

a closed type compressor having a closed casing and a cylinder chamber in which a gas is compressed;

an outer intermediate radiator in communication with said cylinder chamber such that said outer intermediate radiator receives and cools all of said compressed gas from said cylinder chamber;

a return duct through which all of said cooled compressed gas exits from said outer intermediate radiator;

a duplex connection duct including an inner duct and an outer duct in a coaxial arrangement relative to each other; and a suction duct through which said gas is provided to said cylinder chamber;

wherein said inner duct is in communication with said suction duct such that said gas is provided to said cylinder chamber via said suction duct and said inner duct, said outer duct has a first end extending outside said closed casing and a second end which is open and which extends within said closed casing, and said return duct is in communication with said first end of said outer duct whereby all of said cooled compressed gas passes from said outer intermediate radiator through said return duct to said outer duct.

5. An apparatus as recited in claim 4, wherein said inner duct is a common part of said suction duct.

6. An apparatus as recited in claim 4, wherein said second end of said outer duct terminates in a vicinity of a subbearing of said compressor.

7. An apparatus as recited in claim 4, further comprising a condenser, a capillary tube, and an evaporator, and wherein said cooled compressed gas sequentially travels from said outer duct through said closed casing, said condenser, said capillary tube, said evaporator and said suction duct whereby it is returned to said cylinder chamber as said gas.

8. A method for preventing overheating of a compressor comprising the steps of:

a) providing a coolant gas to a cylinder of the compressor via a suction pipe;

b) compressing the coolant gas in the cylinder;

c) introducing all of the compressed coolant gas into a radiator;

d) cooling all of the compressed coolant gas in the radiator; and e) providing all of the cooled compressed gas from the radiator to a duct surrounding the suction pipe thereby cooling the suction pipe.

* * * * *